US010524632B2

(12) United States Patent
Dingert

(10) Patent No.: US 10,524,632 B2
(45) Date of Patent: Jan. 7, 2020

(54) DRAINING DEVICE FOR A WET CLEANING APPARATUS AND PREASSEMBLED UNIT COMPRISING THE DRAINING DEVICE

(71) Applicant: Carl Freudenberg KG, Weinheim (DE)

(72) Inventor: Uwe Dingert, Abtsteinach (DE)

(73) Assignee: CARL FREUDENBERG KG, Weinheim (DE)

( * ) Notice: Subject to any disclaimer, the term of this patent is extended or adjusted under 35 U.S.C. 154(b) by 248 days.

(21) Appl. No.: 15/527,052

(22) PCT Filed: Nov. 23, 2015

(86) PCT No.: PCT/EP2015/077305
§ 371 (c)(1),
(2) Date: May 16, 2017

(87) PCT Pub. No.: WO2016/083281
PCT Pub. Date: Jun. 2, 2016

(65) Prior Publication Data

US 2018/0279849 A1 Oct. 4, 2018

(30) Foreign Application Priority Data

Nov. 28, 2014 (DE) ..... 10 2014 017 559

(51) Int. Cl.
*A47L 13/58* (2006.01)
*A47L 13/59* (2006.01)

(52) U.S. Cl.
CPC ..... *A47L 13/58* (2013.01); *A47L 13/59* (2013.01)

(58) Field of Classification Search
CPC ..... A47L 13/58; A47L 13/59; A47L 15/23; A47L 15/4223; A47L 15/0076; A47L 15/0092; A47L 15/08; A47L 15/16; A47L 15/4221; A47L 15/428; A47L 15/4282; A47L 2401/14; A47L 2401/24;
(Continued)

(56) References Cited

U.S. PATENT DOCUMENTS 4,888,847 A * 12/1989 Montijo ..... A47L 13/58 15/263
5,048,759 A * 9/1991 Mazziotta ..... B05B 1/304 239/529
(Continued)

FOREIGN PATENT DOCUMENTS

CN 2111092 U 7/1992
DE 10311813 B3 7/2004
(Continued)

OTHER PUBLICATIONS

DE-102011017445-A1 Machine Translation from Espacenet (Year: 2012).*

*Primary Examiner* — Sean K. Hunter
*Assistant Examiner* — Robert F Neibaur
(74) *Attorney, Agent, or Firm* — Leydig, Voit & Mayer, Ltd.

(57) ABSTRACT

A draining device for a wet cleaning apparatus has a watering device for the wet cleaning apparatus as well as a rotatable drainage basket for the wet cleaning apparatus; the watering device includes a fresh water reservoir which can be filled with fresh water and which is fluidically connected to the drainage basket via a fresh water duct.

19 Claims, 4 Drawing Sheets

(58) Field of Classification Search
CPC .. A47L 2501/02; A47L 2501/04; A47L 13/20; A47L 15/44; A47L 15/4418; B05B 1/20; D06F 39/08; D06F 39/008; D06F 17/06; D06F 17/08; D06F 37/40; B08B 9/093; A23N 12/02; A23N 12/023
USPC ..... 15/257.01, 260, 263, 104.92, 264, 116.1, 15/119.1; 222/75, 167, 168, 631, 632, 222/633; 134/173, 174, 177, 186, 195, 134/199
See application file for complete search history.

(56) References Cited

U.S. PATENT DOCUMENTS

| | | | | |
|---|---|---|---|---|
| 7,174,601 | B1 * | 2/2007 | Palmer | A47L 13/58 15/260 |
| 8,438,749 | B2 * | 5/2013 | Lee | A47L 13/58 15/260 |
| 8,893,734 | B2 * | 11/2014 | McLain | B24B 53/007 134/104.2 |
| 2006/0032080 | A1 | 2/2006 | Rust et al. | |
| 2007/0039117 | A1 | 2/2007 | Palmer | |

FOREIGN PATENT DOCUMENTS

| | | | | |
|---|---|---|---|---|
| DE | 102011017445 | A1 * | 10/2012 | A47L 13/58 |
| DE | 102011017445 | A1 | 10/2012 | |
| DE | 202013008608 | U1 | 10/2013 | |
| EP | 1860982 | A1 | 12/2007 | |
| GB | 1520839 | A | 8/1978 | |
| WO | 2011000332 | A1 | 1/2011 | |

* cited by examiner

DRAINING DEVICE FOR A WET CLEANING APPARATUS AND PREASSEMBLED UNIT COMPRISING THE DRAINING DEVICE

CROSS-REFERENCE TO RELATED APPLICATIONS

This application is a U.S. national stage application under 35 U.S.C. § 371 of International Application No. PCT/EP2015/077305, filed on Nov. 23, 2015, and claims benefit to German Patent Application No. DE 10 2014 017 559.6, filed on Nov. 28, 2014. The International Application was published in German on Jun. 2, 2016, as WO 2016/083281 A1 under PCT Article 21(2).

FIELD

The invention relates to a draining device for a wet cleaning apparatus and to a preassembled unit comprising said draining device.

BACKGROUND

Such a draining device and such a preassembled unit are known from DE 10 2011 017 445 A1. The known draining device comprises a rotatable draining basket which can be rotated by an electric drive.

The wet cleaning apparatus which can be spun by the draining device is formed by a mop comprising a mop head.

The draining device is secured in a bucket by a securing means in the form of a carrier.

Draining devices for wet cleaning apparatuses from the prior art are exclusively provided to drain wet cleaning apparatuses by spinning. The wet cleaning apparatuses are drained by the draining device to the extent that surfaces to be cleaned can be cleaned using sufficient moisture but without these surfaces suffering damage due to undesirably large quantities of liquid during cleaning or thereafter.

The wet cleaning apparatuses are usually washed out with the used washing water which contains the previously received impurities. In order to prevent the wet cleaning apparatus from remaining undesirably heavily contaminated by being frequently washed out with used washing water, the washing water needs to be changed frequently, which is disadvantageous for the user with regard to as simple and rapid a cleaning as possible.

SUMMARY

An aspect of the invention provides a draining device for a wet cleaning apparatus, the device comprising: a flushing device adapted for the wet cleaning apparatus; and a rotatable draining basket adapted for the wet cleaning apparatus, wherein the flushing device includes a fresh water reservoir which can be filled with fresh water, wherein the fresh water reservoir is fluidically connected to the rotatable draining basket by a fresh water line.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
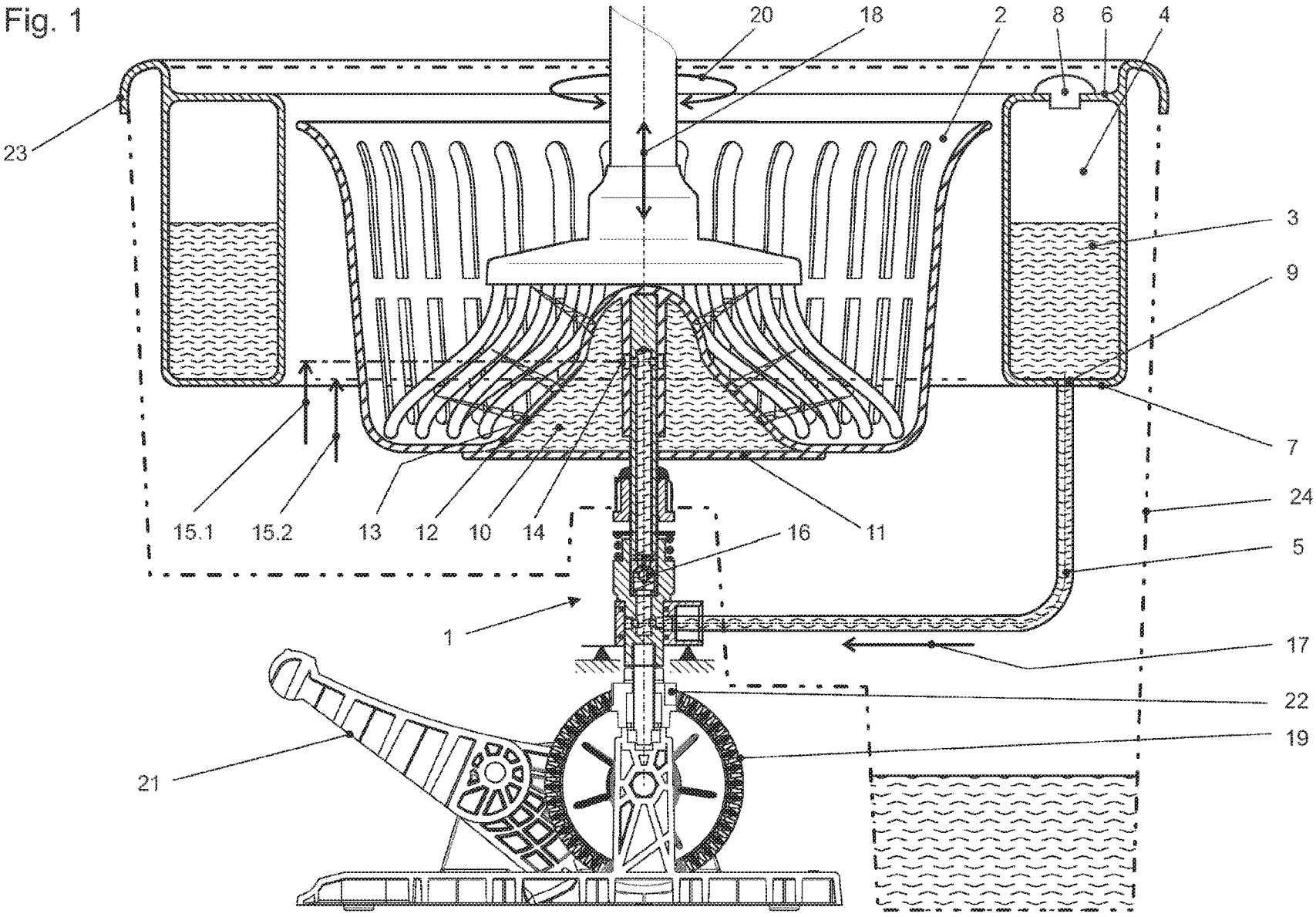
FIG. 1 a draining device comprising an integrated flushing device which is inserted into a container which is open at the top, here a bucket, a wet cleaning apparatus being arranged in the draining basket.

An aspect of the invention is to develop a draining device of the type mentioned at the outset and a preassembled unit which comprises the draining device, such that the wet cleaning apparatus to be drained can be cleaned and/or wetted effectively in the draining device, in addition to impurities being drained.

An aspect of the invention provides a draining device for a wet cleaning apparatus is provided, comprising a flushing device for the wet cleaning apparatus and a rotatable draining basket for the wet cleaning apparatus, the flushing device comprising a fresh water reservoir which can be filled with fresh water and which is fluidically connected to the draining basket by a fresh water line.

Moreover, to achieve an aspect of the invention a preassembled unit is provided comprising the above-described draining device which is arranged in a container which is open at the top.

The advantage of the draining device according to an aspect the invention is mainly that the draining device comprises a flushing device for the wet cleaning apparatus. As a result, it is no longer necessary to wash out the wet cleaning apparatus with the used washing water. It is possible to wash out the wet cleaning apparatus with fresh water and drain the wet cleaning apparatus by means of only one device, specifically the draining device comprising an integrated flushing device. To clean the wet cleaning apparatus, said apparatus is placed in the rotatable draining basket and cleaned by the fresh water from the fresh water reservoir which is guided from there into the draining basket through the fresh water line. The fresh water rinses impurities out from the wet cleaning apparatus effectively. After cleaning the wet cleaning apparatus with fresh water, or at the same time, the draining basket is rotated in order to spin excess moisture out of the wet cleaning apparatus. The fresh water used to clean the wet cleaning apparatus is then guided away after the wet cleaning apparatus has been cleaned, for example to the used washing water which is in any case located in the container/bucket which is open at the top, into which the draining device is inserted.

The fresh water reservoir can be annular and surround the outer periphery of the draining basket. It is advantageous here that the fresh water reservoir can have a large volume as a result, and the wet cleaning apparatus can therefore be washed out frequently without the fresh water reservoir needing to be refilled with new fresh water.

The fresh water reservoir can have an upper face and a lower face, the upper face comprising a filling opening for fresh water and the lower face comprising a connection for the fresh water line. Such a draining device has a structurally simple design and is easy for the user to handle. The filling opening on the upper face of the fresh water reservoir is easily accessible. Additives, which facilitate cleaning of the wet cleaning apparatus, can be mixed into the fresh water as required through this filling opening.

The draining basket can have a shape which is substantially open at the top and cup-like, and can be designed in the shape of a sieve. Such draining baskets are generally advantageous because differently shaped wet cleaning apparatuses, for example a mop comprising a mop head, can be easily placed therein. When the draining basket is rotated, the excess liquid which has been spun out of the wet cleaning apparatus passes out of the draining basket through the openings therein.

The draining basket can preferably consist of a polymer material. Such a draining basket is lightweight, and thus has a low inertial mass and can therefore be driven using a low force.

The draining basket preferably comprises a fresh water dome that is fluidically connected to the fresh water line and pre-bulged in the draining basket, the fresh water dome comprising a base and a casing, the base being designed to be fluid-tight, the casing comprising apertures, and fresh water being able to flow outwards, substantially radially, through the apertures. The fresh water dome contains the fresh water which has been guided out of the fresh water reservoir and through the fresh water line, which water is then used to wet and/or clean the wet cleaning apparatus. Preferably, the fresh water dome is arranged centrally in the base of the draining basket, with the result that the wet cleaning apparatus, for example if it is a mop comprising a mop head, almost completely surrounds the outer periphery of the fresh water dome. The wet cleaning apparatus is thus wetted and/or cleaned particularly uniformly, the fresh water consumption being kept to a minimum by this uniformity.

The fluid-tight base of the fresh water dome is advantageous for preventing the fresh water located in the fresh water dome from running downwards through the base immediately after being supplied to the fresh water dome and thus no longer being available for wetting and/or cleaning the wet cleaning apparatus. The fresh water located in the fresh water dome can escape from the fresh water dome only through the apertures in the casing.

The fresh water line can comprise an outflow opening which opens into the fresh water dome and which has a first height that is no greater than a second height of the connection of the fresh water reservoir. The fresh water reservoir and the fresh water dome are associated with one another in the manner of communicating tubes. The aforementioned heights guarantee that the fresh water from the fresh water reservoir is almost completely used up in order to wet the wet cleaning apparatus and/or rinse it out with fresh water.

According to an advantageous embodiment, it can be provided that the fresh water line comprises a flow valve through which liquid can flow only in the direction of the fresh water dome, which valve is arranged in the flow direction between the fresh water reservoir and the fresh water dome. In the simplest case, the fresh water supply from the fresh water reservoir to the fresh water dome can be completely interrupted or completely released by the flow valve, as required.

Depending on the design of the flow valve, however, there is also the possibility of controlling/regulating the size of the volume flow from the fresh water reservoir to the fresh water dome.

The flow valve can be formed by a check valve which closes in the direction of the fresh water reservoir. Check valves are simple and reliably functioning machine elements which are available cheaply for the most varied applications.

According to a first embodiment, liquid can flow through the flow valve only when the draining basket is rotating. It is advantageous here that the fresh water consumption of the flushing device is kept to a minimum. Only if the wet cleaning apparatus is placed in the draining basket and the draining basket is rotating does the flow valve release the fresh water line and the fresh water flow out of the fresh water reservoir through the fresh water line and into the fresh water dome which is arranged in rotationally fixed manner in the draining basket. The draining basket and the fresh water dome rotate at the same speed as the wet cleaning apparatus which is placed in the draining basket. As a result of the rotation of the draining basket and the fresh water dome, the fresh water is spun out through the apertures in the casing of the fresh water dome to the wet cleaning apparatus and cleans the wet cleaning apparatus, the liquid spun out from the wet cleaning apparatus passing through the sieve-shaped draining basket for example into a bucket in which the draining device is arranged.

According to a second embodiment it can be provided that liquid can flow through the flow valve either when the draining basket is rotating or when it is not. If liquid flows through the flow valve when the draining basket is not rotating it can be expedient if a completely dry wet cleaning apparatus is initially wetted before first use in order to have good performance characteristics. In such a case, the dry wet cleaning apparatus is placed in the draining basket, the flow valve is opened and fresh water from the fresh water reservoir passes through the fresh water line into the fresh water dome and from there to the dry wet cleaning apparatus. After wetting, the wet cleaning apparatus can initially be spun or can immediately be used as intended. The wet cleaning apparatus used as intended is cleaned as described above.

The flow valve can be actuated by an axial movement of the draining basket. It is particularly simple for the user to perform such an actuation of the flow valve.

The flow valve can be spring-loaded. As a result of this, it is simple to bring the flow valve into the open or closed position.

The flow valve can be actuated such that, when the draining basket is axially loaded, the flow valve can be brought into open position under pressure. In order to bring the flow valve into the open position it is preferably sufficient if the wet cleaning apparatus to be cleaned is placed in the draining basket. According to a preferred embodiment, the dead weight of the wet cleaning apparatus is sufficient to ensure that fresh water is guided through the fresh water dome to the wet cleaning apparatus in order to clean said apparatus. The draining device can be operated with little physical effort on the part of the user.

When the draining basket is unloaded, the flow valve can be brought into the closed position in a spring-loaded manner. As soon as the wet cleaning apparatus which has been cleaned by fresh water and spun has been lifted out of the draining basket by the user, the flow valve seals the fresh water line. The operation of such a draining device is virtually self-explanatory for a user.

The draining basket can be rotated by means of a drive. Generally it is possible for the drive to be mechanical. As a result, the draining device has a simple design and can be produced cost-effectively. Moreover, said device can also be operated if there is no power available to operate an electric drive.

Such a mechanical drive can for example be formed by a pedal which can be actuated by foot and comprises a connected gearing mechanism. When using the draining device, the user stands on one foot, uses the other foot to actuate the pedal, and manually holds the wet cleaning apparatus to be cleaned/spun in the draining basket. The gearing mechanism can be provided to convert an up and down movement of the pedal into a rotation movement of the draining basket.

Moreover, the gearing mechanism can have a transmission in order to translate the up and down movement of the pedal into the appropriate rotational speed for the draining basket and the fresh water dome.

According to another embodiment, it is possible for the drive to be electric. As a result, the draining device can be actuated particularly simply and with little physical effort.

The electric drive can for example comprise a battery which supplies energy to the electric motor of the electric drive.

The draining device can comprise a securing means, by means of which the draining device can be inserted into a container which is open at the top, for example a bucket. The whole draining device can be connected to different containers, which are open at the top, by the securing means which for example is formed by a collar which surrounds the outer periphery of the flushing device and the draining basket.

The above-described draining device and the container which is open at the top then form a preassembled unit.

An embodiment of the draining device according to the invention and the preassembled unit according to the invention are described in more detail below with reference to FIGS. 1 to 4.

FIG. 1 shows an embodiment of the draining device according to the invention for a wet cleaning apparatus. In the embodiment shown, the wet cleaning apparatus is formed by a mop, the mop head of which is arranged in the draining basket. The flushing device 1, which forms an integral component of the draining device, is provided for cleaning the wet cleaning apparatus and/or to wet the wet cleaning apparatus. The flushing device 1 comprises a fresh water reservoir 4 filled with fresh water, which reservoir is annular and surrounds the outer periphery of the draining basket 2 in the manner of an annulus. On its upper face 6, the fresh water reservoir 4 has a filling opening 8 for fresh water 3 and optionally cleaning additives, and on its lower face 7, a connection 9 for the fresh water line 5.

The fresh water line 5 connects the fresh water reservoir 4 to the draining basket 2.

The fresh water dome 10, which is axially pre-bulged in the draining basket 2, is arranged on the bottom of draining basket 2. The fresh water dome 10 is fluidically connected to the fresh water reservoir 4 by the fresh water line 5. The base 11 of the fresh water dome 10 is fluid-tight and the casing 12 has apertures 13 through which, as indicated schematically here, fresh water 3 can flow outwards in the radial direction.

The draining device is hooked, by a securing means 23 designed as a retaining collar, to the edge of the container 24 which is open at the top and is designed as a bucket. As a result, the preassembled unit is formed which comprises the draining device itself and the container 24.

In FIG. 1 the draining device is shown during cleaning of the cleaning apparatus and during spinning of the wet cleaning apparatus.

The flow valve 16, which is arranged in the flow direction 17 between the fresh water reservoir 4 and the fresh water dome 10, is in the open position. The flow valve 16 is transferred into open position by pressure being applied to the draining basket in the axial direction, also by the dead weight of the wet cleaning apparatus, such that the spring-loaded flow valve 16 is kept in the open position. As a result, liquid can flow through the fresh water line 5.

Provided that the draining basket 2 is in the position shown here and thus keeps the flow valve 16 in the open position, fresh water 3 flows out of the fresh water reservoir 4 through the fresh water line 5, and through the flow valve 16 into the fresh water dome 10 where, due to the rotation of the draining basket 2 and the fresh water dome 10 which is associated with the draining basket 2 so as to be stationary relative thereto, said water is spun outwards radially through the apertures 13 in the casing 12 of the fresh water dome 10, and thus cleans the mop head of the wet cleaning apparatus. After the mop head has been cleaned by the sieve-shaped draining basket 2, the fresh water used to clean the wet cleaning apparatus passes radially outwards into the container 24 and collects there together with the used washing water which is already in the container 24.

In the embodiment shown here, the rotation of the draining basket 2 does not depend on whether or not the fresh water dome 10 is supplied with fresh water 3.

Generally, it is also possible to push the draining basket 2 that is not in rotation 20 axially downwards, as shown here. The wet cleaning apparatus can be wetted, for example if it has not been used for a long time, is completely dry and is intended to be prepared for use as intended by wetting, without the draining basket 2 rotating.

The outflow opening 14 which opens into the fresh water dome 10 has a first height 15.1 which is less than the second height 15.2 of the connection 9 of the fresh water reservoir 4. The fresh water dome 10 and the fresh water reservoir 4 are interconnected in the manner of communicating tubes provided that, as shown here, the flow valve 16 is in the open position.

The drive 19 by means of which the draining basket 2 can be rotated 20 is mechanical in the example shown here. The drive 19 is formed by a pedal 21 which can be actuated by foot and comprises a connected gearing mechanism 22, the gearing mechanism 22 translating the up and down movement of the pedal 21 into a rotational movement to drive the draining basket 2.

Figure 2:
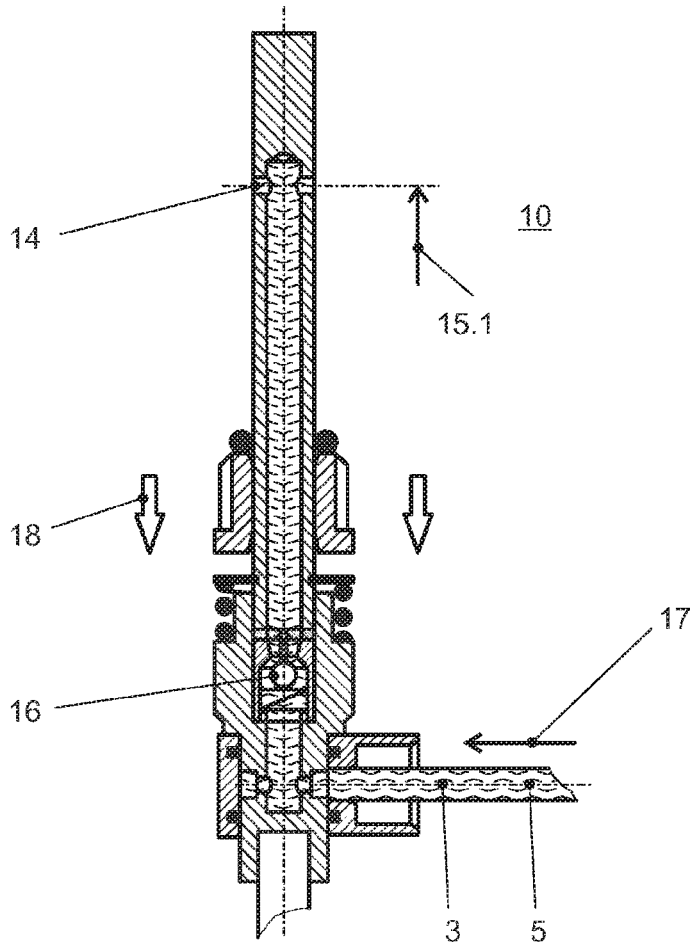
FIG. 2 the flow valve from FIG. 1 in the open position.

FIG. 2 is an enlarged view of the flow valve 16 from FIG. 1. It is shown schematically that the flow valve 16 is moved axially downwards into the open position by the movement of the draining basket 2. The fresh water line 5 fluidically connects the fresh water reservoir 4 to the fresh water dome 10.

Figure 3:
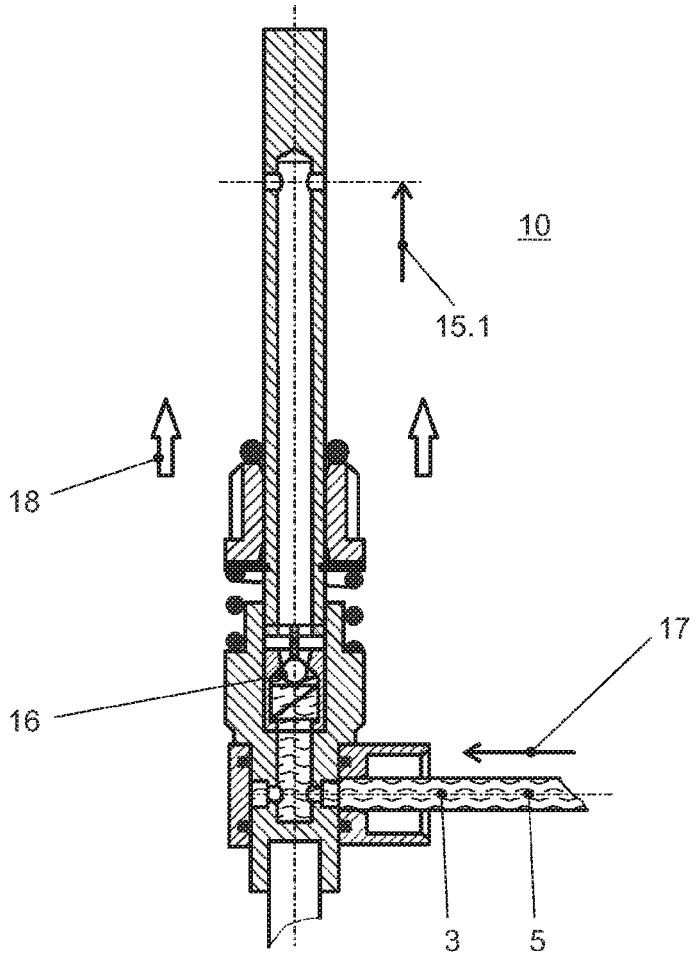
FIG. 3 the flow valve from FIG. 4 in the closed position.

In FIG. 3, the flow valve from FIG. 2 is shown in the closed position. The draining basket 2 is unloaded here, as shown for example in FIG. 4, the unloading taking place by removing the wet cleaning apparatus from the draining basket 2.

Figure 4:
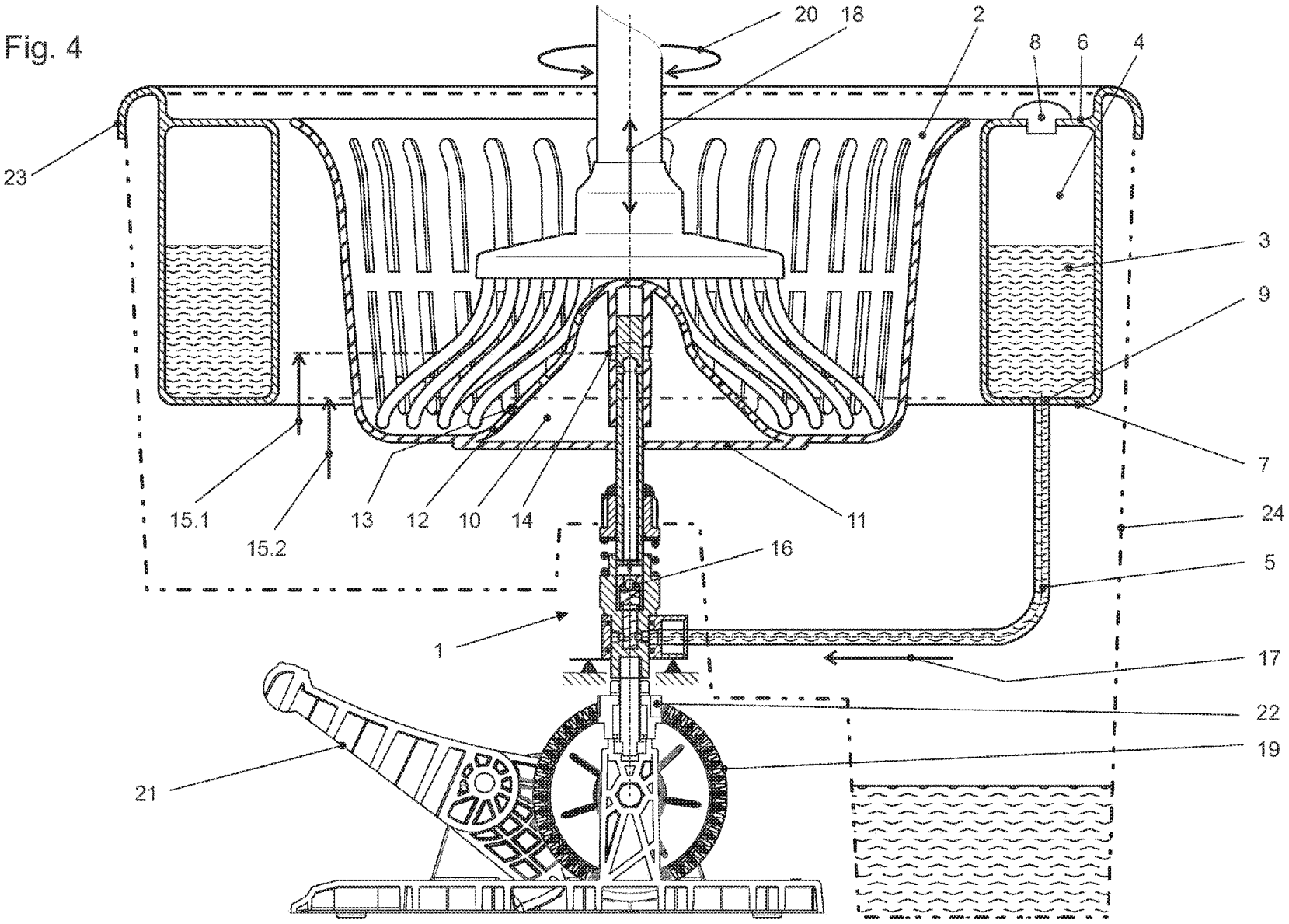
FIG. 4 the draining device from FIG. 1 without the wet cleaning apparatus and in the rest position.

Due to the unloading of the draining basket 2, said basket moves in spring-loaded manner into the starting position shown in FIG. 4, and the flow valve 16 closes the fresh water line 5. This means that there is no longer a fluidic connection between the fresh water reservoir 4 and the fresh water dome 10.

In FIG. 4, the draining device is shown in a state in which it is not loaded by the wet cleaning apparatus. It should be noted that the draining basket 2 is moved axially upwards, relative to the position of the draining basket 2 in FIG. 1, the flow valve 16 being brought into the closed position by this axial upward movement of the draining basket 2.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A draining device for a wet cleaning apparatus, the device comprising:

a flushing device adapted for the wet cleaning apparatus; and a rotatable draining basket adapted for the wet cleaning apparatus, wherein the flushing device includes a fresh water reservoir fillable with fresh water, wherein the fresh water reservoir is fluidically connected to the rotatable draining basket by a fresh water line, wherein the rotatable draining basket includes a fresh water dome which is fluidically connected to the fresh water line and is pre-bulged in the draining basket, wherein the fresh water dome includes a base and a casing, wherein the base is configured to be fluid-tight, and wherein the casing includes apertures configured so as to permit fresh water to flow outwards, radially, through the apertures.

2. The device of claim 1, wherein the fresh water reservoir is annular and surrounds an outer periphery of the rotatable draining basket.

3. The device of claim 1, wherein the fresh water reservoir includes an upper face and a lower face, wherein the upper face includes a filling opening for through which the fresh water is receivable, and wherein the lower face includes a connection adapted for the fresh water line.

4. The device of claim 1, wherein the rotatable draining basket has a shape which is substantially open at the top and cup-like, and is designed in the shape of a sieve.

5. The device of claim 1, wherein the fresh water line includes an outflow opening which opens into the fresh water dome, and wherein the outflow opening has a first height which substantially corresponds to a second height of the connection of the fresh water reservoir.

6. The device of claim 1, wherein the fresh water line includes a flow valve configured to permit liquid to flow through only in a direction of the fresh water dome, wherein the flow valve is arranged in a flow direction between the fresh water reservoir and the fresh water dome.

7. The device of claim 6, wherein the flow valve comprises a check valve which closes in a direction of the fresh water reservoir.

8. The device of claim 6, wherein the flow valve is configured to permit liquid to flow through the flow valve only when the rotatable draining basket is rotating.

9. The device of claim 6, wherein the flow valve is configured to permit liquid can flow through the flow valve either when the rotatable draining basket is rotating or when it is not.

10. The device of claim 6, wherein the flow valve is actuatable by an axial movement of the rotatable draining basket.

11. The device of claim 6, wherein the flow valve is spring-loaded.

12. The device of claim 6, wherein the flow valve is configured to be actuated such that, when the rotatable draining basket is axially loaded, the flow valve is configured to be brought into an open position under pressure.

13. The device of claim 6, wherein, when the rotatable draining basket is unloaded, the flow valve is configured to be brought into the closed position in a spring-loaded manner.

14. The device of claim 1, wherein the rotatable draining basket is configured to be rotatable using a drive.

15. The device of claim 14, wherein the drive is mechanical.

16. The device of claim 15, wherein the drive includes a pedal that is actuatable by foot and a connected gearing mechanism.

17. The device of claim 14, wherein the drive is electric.

18. The device of claim 1, further comprising:

a securer, wherein the draining device is insertable into a container, which is open at the top, using the securer.

19. A preassembled unit, comprising:

the device of claim 1, arranged in a container which is open at the top.

* * * * *